US011661270B2

(12) United States Patent
Stefanoni

(10) Patent No.: US 11,661,270 B2
(45) Date of Patent: May 30, 2023

(54) SINGLE USE CAPSULE FOR MACHINES FOR THE DISPENSING OF INFUSED BEVERAGES

(71) Applicant: IMPER S.P.A., Turin (IT)

(72) Inventor: Roberto Stefanoni, Oggiono (IT)

(73) Assignee: IMPER S.P.A., Turin (IT)

( * ) Notice: Subject to any disclaimer, the term of this patent is extended or adjusted under 35 U.S.C. 154(b) by 519 days.

(21) Appl. No.: 16/061,520

(22) PCT Filed: Dec. 16, 2015

(86) PCT No.: PCT/IT2015/000313
§ 371 (c)(1),
(2) Date: Jun. 12, 2018

(87) PCT Pub. No.: WO2017/103952
PCT Pub. Date: Jun. 22, 2017

(65) Prior Publication Data

US 2020/0262693 A1 Aug. 20, 2020

(51) Int. Cl.
*B65D 85/804* (2006.01)
*B65B 29/02* (2006.01)
*B67D 1/00* (2006.01)

(52) U.S. Cl.
CPC ..... *B65D 85/8046* (2013.01); *B65B 29/022* (2017.08); *B65D 85/8049* (2020.05); (Continued)

(58) Field of Classification Search
CPC ..... B65D 85/8043; B65D 85/8049; B65D 85/8052; B65B 29/022; B67D 1/0078
See application file for complete search history.

(56) References Cited

U.S. PATENT DOCUMENTS

2003/0217643 A1* 11/2003 Masek ..... B65D 85/8043 99/279
2004/0115317 A1 6/2004 Doglioni
(Continued)

FOREIGN PATENT DOCUMENTS

EP 1426160 A1 6/2004
EP 1472156 B1 3/2006
(Continued)

OTHER PUBLICATIONS

International Search Report and Written Opinion for International Application No. PCT/IB2016/052638 (dated Sep. 6, 2016) (12 Pages).
(Continued)

*Primary Examiner* — Drew E Becker
*Assistant Examiner* — Chaim A Smith
(74) *Attorney, Agent, or Firm* — Lucas & Mercanti, LLP

(57) ABSTRACT

A single-dose capsule for machines for dispensing beverages in the form of an infusion is provided. The capsule has a cup-shaped body adapted to receive a dose of a product in a granular or particle form, or in the form of a concentrated liquid, and a gas-impermeable film restrained to the open top of the cup-shaped body. The cup-shaped body is made of a multilayer material manufactured by way of a co-injection molding process. The multilayer has an inner layer and an outer layer made of a structural material and an intermediate layer made of a barrier material adapted to prevent passage of oxygen from the external environment to the inside of the cup-shaped body. The invention also relates to a packaging method of the single-dose capsules.

12 Claims, 4 Drawing Sheets

(52) U.S. Cl.
CPC ..... *B65D 85/8052* (2020.05); *B65D 85/8061* (2020.05); *B67D 1/0078* (2013.01)

(56) References Cited

U.S. PATENT DOCUMENTS

| | | | | |
|---|---|---|---|---|
| 2013/0105340 | A1 | 5/2013 | Hother et al. | |
| 2014/0053735 | A1 | 2/2014 | Verbeek | |
| 2014/0190863 | A1* | 7/2014 | Fabozzi ..... | B29C 45/14336 206/524.6 |
| 2018/0134485 | A1 | 5/2018 | Stefanoni | |

FOREIGN PATENT DOCUMENTS

| | | | |
|---|---|---|---|
| EP | 1344722 | B2 | 10/2011 |
| WO | 03059778 | A2 | 7/2003 |
| WO | 2004065257 | A1 | 8/2004 |
| WO | 2004084687 | A1 | 10/2004 |
| WO | 2008132571 | A1 | 11/2008 |
| WO | 2012121597 | A1 | 9/2012 |
| WO | 2013026651 | A1 | 2/2013 |
| WO | 2013124234 | A1 | 8/2013 |
| WO | 2013144838 | A1 | 10/2013 |
| WO | 2014102701 | A1 | 7/2014 |
| WO | 2014195307 | A1 | 12/2014 |
| WO | 2015032787 | A1 | 3/2015 |
| WO | 2015059020 | A2 | 4/2015 |
| WO | 2015059022 | A1 | 4/2015 |
| WO | 2015124526 | A1 | 8/2015 |
| WO | 2015124558 | A1 | 8/2015 |
| WO | 2015136433 | A1 | 9/2015 |

OTHER PUBLICATIONS

International Search Report and Written Opinion for International Application No. PCT/IB2016/057865 (dated Apr. 3, 2017) (12 Pages).

International Search Report and Written Opinion for International Application No. PCT/IT2015/000313 (dated Sep. 7, 2016) (10 Pages).

International Preliminary Report on Patentability for International Application No. PCT/IT2015/000313 (dated Dec. 7, 2017) (13 Pages).

International Search Report and Written Opinion for International Application No. PCT/EP2016/071682 (13 Pages) (dated Oct. 21, 2016).

* cited by examiner

SINGLE USE CAPSULE FOR MACHINES FOR THE DISPENSING OF INFUSED BEVERAGES

CROSS-REFERENCE TO RELATED APPLICATIONS

This application is a 371 of PCT/IT2015/000313, filed Dec. 16, 2015.

TECHNICAL FIELD OF THE INVENTION

The present invention generally relates to the preparation of hot beverages in the form of infusion, such as e.g. coffee, tea, herb teas and the like, starting from a capsule and in particular to a single-dose capsule for machines for the dispensing of infused beverages.

BACKGROUND

Single-dose capsules used in machines for dispensing infused beverages contain a product in granular or particulate form, for example coffee. It is known that a beverage is obtained through an "infusion" process, whereby the capsule with the granular product is crossed by an infusion liquid, typically water, that is fed under pressure at a high temperature. The infusion liquid coming out from the capsule is enriched by the aroma of the product in granular form and forms the desired beverage, which is suitably channeled inside a dispensing machine and served from a dispensing head thereof e.g. into a cup.

Known single-dose capsules comprise a cup-shaped body whose open top is hermetically closed by a film impermeable to gases that has the function of allowing the preservation over time of the product in granular form, while preventing it from escaping.

During the infusion process, the capsule is fitted into an infusion chamber and is subsequently perforated with special perforators both at the bottom of the cup-shaped body and at the top, which is sealed by the film impermeable to gases. The holes so made allow passage of a liquid flow through the cup from one end to the opposite end thereof. Depending on the type of dispensing machine, the liquid can proceed from the bottom of the cup-shaped body towards the top or in the opposite direction.

Consequently, each dispensing machine requires a specific type of single-dose capsule.

SUMMARY OF THE INVENTION

The technical problem posed and solved by the present invention is therefore to provide a single-dose capsule suitable to be processed by different types of machines for dispensing infused beverages, as well as a method for its packaging.

Said object is achieved with a single-dose capsule and packaging method, whose main features are specified in claims 1 and 18, respectively, while other features are specified in the remaining claims.

An idea of solution underlying the invention is to make the cup-shaped body of a single-dose capsule of a multilayer material comprising an inner layer and an outer layer made of a structural material, for example polypropylene, and an intermediate layer made of a barrier material, for example a copolymer of ethylene-polyvinyl alcohol, adapted to prevent passage of oxygen from the external environment into the cup-shaped body. Thanks to this configuration, it is possible to obtain a single-dose capsule inherently protected against passage of oxygen without the need to resort to an expensive, special packaging dedicated to the purpose. The packaging of single-dose capsules according to the invention is thus more simple, cheap and long-lasting than the packaging of known single-dose capsules.

Based on such a cup-shaped body, the single-dose capsule is packaged and configured in a particular way, i.e. customized, depending on the type of machine to which it is intended. For this purpose different combinations of materials for the sealing of the open top, as well as for the sealing of a possible through opening formed in the bottom wall of the cup-shaped body are employed, the sealing of the bottom wall being required by some types of dispensing machine.

Thanks to the choice of particular combinations of materials, the single-dose capsules that may be obtained through the packaging method of the invention can be configured such that the infusion liquid crosses the capsule from the top to the bottom wall, in the opposite direction or indifferently in any one of the two directions.

Another advantage provided by the invention is that the single-dose capsules may be configured so as to contain either granular or particulate products, as well as concentrated liquid products like syrups.

Further advantages, features and the modes of implementation of the present invention will become clear from the following detailed description of some embodiments thereof, given by way of non-limiting example.

BRIEF DESCRIPTION OF THE DRAWINGS

Reference will be made to the figures of the attached drawings, wherein.

DETAILED DESCRIPTION OF PREFERRED EMBODIMENTS

Figure 1:
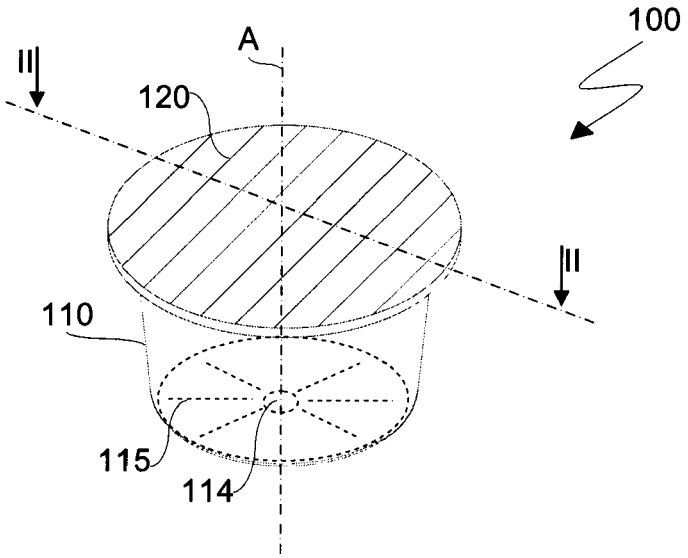
FIG. 1 is an assembly perspective view of a first type of single-dose capsule made according to the method of the invention.

Referring to the figures, a single-dose capsule according to the invention is generally indicated by the reference numeral 100.

The single-dose capsule 100 comprises a cup-shaped body 110 which has a bottom wall 111 and a side wall 112. The peripheral edge of the side wall 112 defines an opening at the top of the cup-shaped body 110 adapted to allow introduction of a predetermined amount of a granular or particulate product, for example coffee powder, or in the form of a concentrated liquid like syrup.

Along the peripheral edge of the side wall 112 a flange 113 is formed, which allows to mount a gas-impermeable film 120 suitable to seal inside the capsule 100 the product (not shown) contained therein, being it a granular or particulate product or a concentrated liquid.

According to the invention, the cup-shaped body 110 is made of a multilayer material comprising an inner layer and an outer layer made of a structural material, such as polypropylene, and an intermediate layer made of a barrier material capable of preventing passage of oxygen from the external environment into the cup-shaped body. Materials with barrier function suitable to be used in the present invention are for example copolymers of ethylene-polyvinyl alcohol, known under the acronym EVOH.

According to the invention, the cup-shaped body made of a multilayer material is obtained through a special co-injection process of the structural material and the barrier material, the process employing injector nozzles with coaxial channels as disclosed by the European patent EP 1426160 B1. In such a process the barrier material is injected through a central channel of a nozzle, while the structural material is injected through a channel coaxial to the central channel, so that the flow is formed by a "core" of barrier material surrounded by a "skin" of structural material.

The use of a multilayer material obtained by co-injection of a structural material and a barrier material as described above allows to make a single-dose capsule inherently protected against the passage of oxygen without the need to resort to a dedicated expensive, special packaging. The packaging of single-dose capsules according to the invention is thus altogether more simple and long-lasting than that of known single-dose capsules.

According to an embodiment of the invention, the gas-impermeable film 120 that seals the top of the cup-shaped body 110 may be made of a polylaminate or multilayer material comprising a first layer 121 made of polyethylene terephthalate (PET) having a thickness preferably comprised between 10 and 15 microns, a second layer 122 of aluminum having a thickness preferably comprised between 35 and 40 microns and a third layer 123 made of polypropylene (PP) having a thickness in the order of 20 microns.

Figure 2:
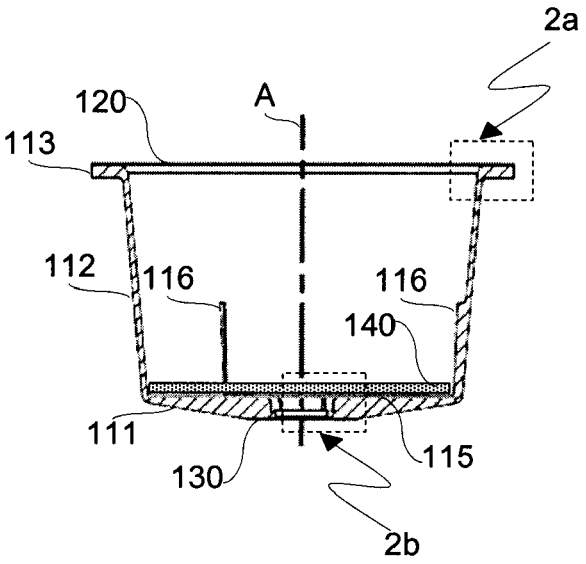
FIG. 2 is a longitudinal sectional view taken along a plane passing through line II-II of FIG. 1 and through the axis of the single-dose capsule.
Figure 2A:
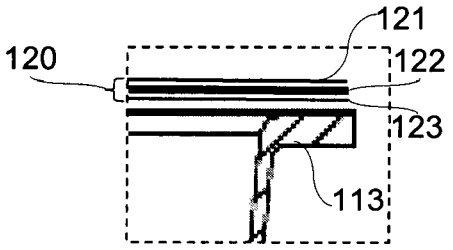
FIGS. 2*a* and 2*b* show two details of FIG. 2.
Figure 2B:
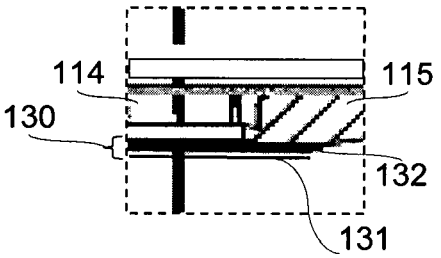

The layers 121, 122 and 123 are schematically shown in the detailed view of FIG. 2*a*. For clarity's sake and simplicity of representation, the thickness of every one of the layers is intentionally larger than the real one.

As shown in FIG. 2*a*, in an assembled configuration of the single-dose capsule the third layer 123 made of the polypropylene mates the flange 113 of the cup-shaped body 110, thus allowing assembly of the film 120 on the latter by heat sealing.

The above configuration of the film 120 sealing the top of the cup-shaped body 110 is advantageous, because it allows to easily perforate it by way of a perforator means of a dispensing machine. Aluminum in fact is an easily pierceable material. The provision of a layer made of polyethylene terephthalate applied on the aluminum layer allows to provide the film 120 with a good tearing resistance during the passage of water under pressure during the infusion step of the beverage. Hence, the size of the holes remains substantially constant during the infusion process and the risk of failure of the film and related product loss from the capsule fitted in the infusion chamber of a dispensing machine is minimized.

Alternatively, the film 120 may be made of a polylaminate or multilayer comprising a first layer made of polyethylene terephthalate modified with EVOH having a thickness preferably comprised between 10 and 15 microns, a second layer made of polyethylene terephthalate of a thickness preferably comprised between 10 and 15 microns, and a third layer made of polypropylene having a thickness in the order of 30 microns.

Still alternatively, the film 120 may be made of a multilayer comprising a first layer made of aluminum having a thickness preferably comprised between 35 and 40 microns and a second layer made of polypropylene having a thickness in the order of 20 microns.

In any case, the polypropylene layer is always arranged in contact with the cup-shaped body so as to allow heat sealing of the film 120.

According to an embodiment of the invention, the cup-shaped body 110 may be advantageously provided with a through-opening 114 formed in the bottom wall 111. This opening is preferably arranged in a central position of the bottom wall 111 and is sealed by a gas-impermeable film 130 attached to the outside of the cup-shaped body 110 and secured thereto.

The film 130 may be advantageously made of a multilayer comprising a first layer 131 made of aluminum preferably having a thickness comprised between 35 and 40 microns and a second layer 132 made of polypropylene having a thickness in the order of 20 microns. In an assembled configuration of the capsule 100, the second layer 132 made of polypropylene mates the outer surface of the bottom wall 111 of the cup-shaped body 110, thus allowing heat sealing of the film 130.

The provision of an opening 114 in the bottom wall 111 allows to eliminate from the cup-shaped body 110 the portion at which the injection point of the injection molded piece is located. In fact, due to manufacturing reasons, this portion of the cup-shaped body 110 generally has a thickness slightly greater than the other portions, such as the side wall 112 or the flange 113, and typically presents a residue of the injection sprue. Consequently, in dispensing machines which carry out perforation of the bottom wall 111 of the capsule 100 at the center thereof, opening of the capsule requires high perforation forces and perforators means suitable for the purpose. On the contrary, by eliminating the central portion of the bottom wall 111 of the cup-shaped body 110 and by sealing the opening 114 so obtained with the film 130, it is possible to use the single-dose capsule 100 according to the invention on most types of dispensing machines having different perforator means.

The capsule according to the invention may also comprise a filter 140, preferably made of paper, arranged on the bottom wall 111 of the cup-shaped body 110. The filter 140 has the function to prevent leakage of the product from the single-dose capsule once this has been perforated so as to carry out the infusion step of the beverage.

The bottom wall 111 of the cup-shaped body 110 may comprise a plurality of radial ribs 115 on which the filter 140 is arranged. Accordingly, the filter 140 is spaced from the bottom wall 111.

In order to allow extraction of the cup-shaped body 110 from a mold, the latter has a generally frusto-conical geometry. In order to facilitate centering of the filter 140 onto the bottom wall 111, the side wall 112 may advantageously comprises a plurality of longitudinal ribs 116 parallel to an axis A of the cup-shaped body 110.

It will be appreciated that the different combinations of materials mentioned above allow to manufacture a plurality of single-dose capsules suitable to be used with different types of machines for dispensing infused beverages, i.e. capsules customized according to specific requirements, which solves the technical problem underlying the invention. Such single-dose capsules share the same cup-shaped body.

The packaging method according to the invention provides the steps of:

(a) providing a cup-shaped body made of a multilayer material and obtained by way of a co-injection molding process, said multilayer material comprising an inner and an outer layer made of a structural material and an intermediate layer made of a barrier material adapted to prevent passage of oxygen, said body being common to each of said single-dose capsules;

(b) configuring each capsule based on a specific machine for dispensing beverages in the form of an infusion by selecting one of the following sets of operations:

(b1.1) piercing a bottom wall of the cup-shaped body;

(b1.2) sealing the opening thus obtained by way of a multilayer comprising a layer made of aluminum and a layer made of polypropylene;

(b1.3) arranging a filter on the bottom wall;

(b1.4) filling the cup-shaped body with a measured dose of a product in granular or particulate form or in the form of a concentrated liquid;

(b1.5) sealing the top opening of the cup-shaped body with a gas-impermeable film, said film being a polylaminate.

(b2.1) filling the cup-shaped body with a measured dose of a product in granular or particulate form or in the form of a concentrated liquid;

(b2.2) sealing the top opening of the cup-shaped body with a gas-impermeable film, said film being a multilayer comprising a first layer made of aluminum and a second layer made of polypropylene.

(b3.1) piercing a bottom wall of the cup-shaped body;

(b3.2) sealing the opening thus obtained by means of a multilayer comprising a layer made of aluminum and a layer made of polypropylene;

(b3.3) arranging a filter on the bottom wall;

(b3.4) filling the cup-shaped body with a measured dose of a product in granular or particulate form or in the form of a concentrated liquid;

(b3.5) sealing the top opening of the cup-shaped body with a gas-impermeable film, said film being a multilayer comprising a first layer made of aluminum and a second layer made of polypropylene.

The polylaminate material sealing the top of the cup-shaped body in step (b1.5) may comprise a first layer of polyethylene terephthalate, a second layer of aluminum and a third layer of polypropylene, wherein the first layer of polyethylene terephthalate has a thickness preferably comprised between 10 and 15 microns, the second layer of aluminum has a thickness preferably comprised between 35 and 40 microns and the third layer of polypropylene has a thickness in the order of 20 microns.

Alternatively, the polylaminate material that seals the top of the cup-shaped body in step (b1.5) may comprise a first layer of polyethylene terephthalate modified with EVOH, a second layer of polyethylene terephthalate and a third layer of polypropylene, wherein the first layer of polyethylene terephthalate modified with EVOH has a thickness comprised between 10 and 15 microns, the second layer of polyethylene terephthalate has a thickness comprised between 10 and 15 microns and the third layer of polypropylene has a thickness in the order of 30 microns.

The multilayer sealing the opening on the bottom wall of the cup-shaped body in steps (b1.2) and (b3.2) comprises a first layer of aluminum having a thickness preferably comprised between 35 and 40 microns and a second layer of polypropylene having a thickness preferably in the order of 20 microns.

The multilayer that seals the top of the cup-shaped body in steps (b2.2) and (b3.5) comprises a first layer of aluminum having a thickness preferably comprised between 35 and 40 microns and a second layer of polypropylene having a thickness preferably in the order of 20 microns.

A beverage infusion process carried out with a single-dose capsule 100 according to the invention requires in a known way the perforation of the film 120 and of the bottom wall 111 of the cup-shaped body 110 by way of respective perforator means of a dispensing machine. When on the bottom wall 111 an opening 114 is formed, perforation of the film 130 is instead required.

Depending on the type of dispensing machine, the infusion liquid supplied under pressure and at high temperature may for instance be fed from the top to the bottom of the cup-shaped body 110 or in the opposite direction.

Figure 3:
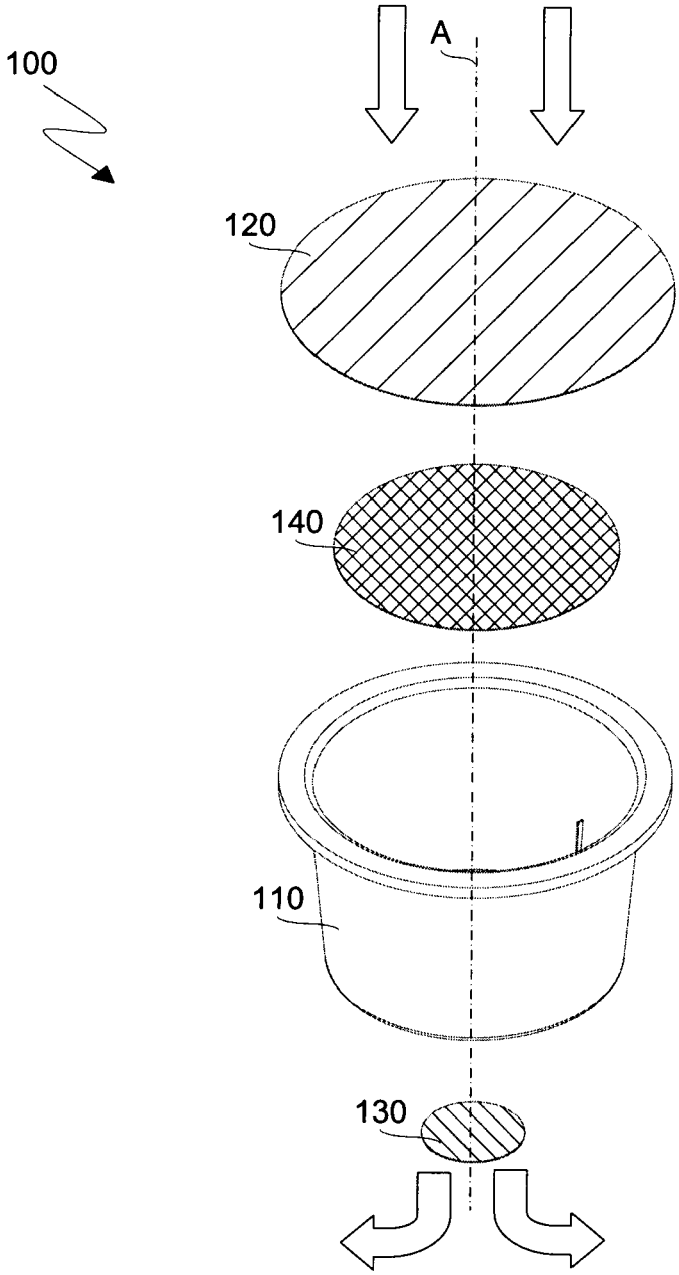
FIGS. 3 to 5 are exploded perspective views showing three different types of single-dose capsules that may be obtained with the method according to the invention.

Single-dose capsules made according to steps (a) and (b1.1) to (b1.5) are configured in such a way that the top of the cup-shaped body 110 serves as an inlet for the infusion liquid and the opening 114 provided on the bottom wall serves as outlet of infused beverage. This type of capsule is shown in the exploded view of FIG. 3, wherein the flow of the infusion fluid is schematically indicated by way of arrows.

Figure 4:
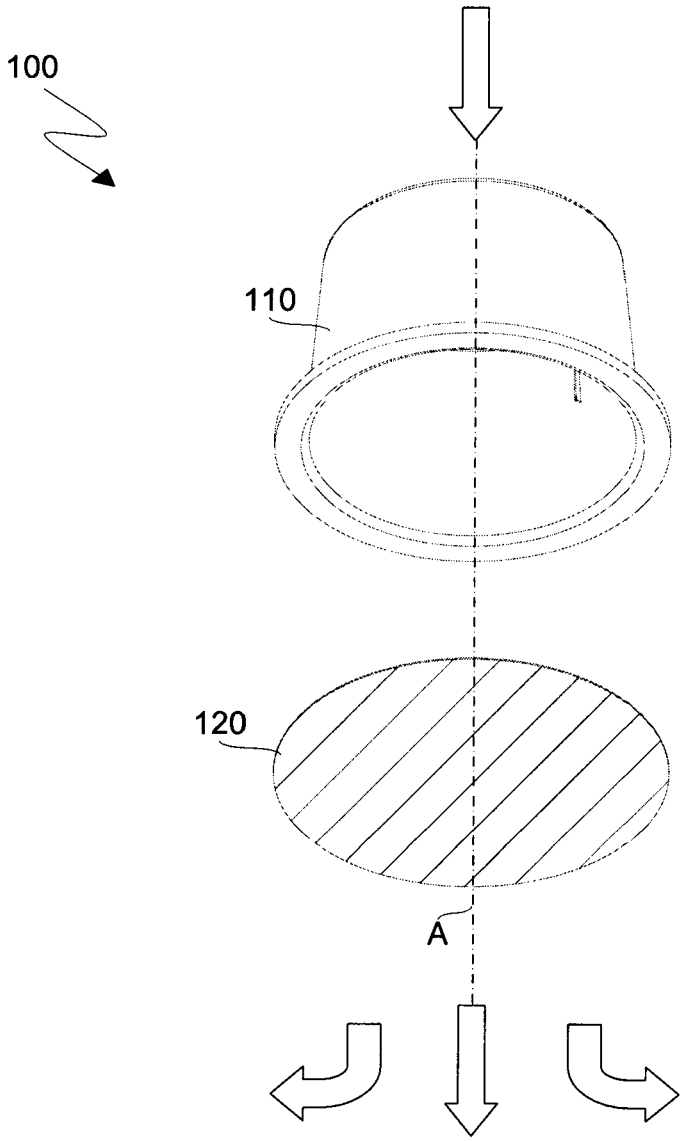

Single-dose capsules made according to steps (a) and (b2.1) to (b2.2) are configured in such a way that the bottom of the cup-shaped body 110, perforated by a suitable perforator, serves as an inlet for the infusion liquid and the top of the cup-shaped body 110 serves as outlet of the infused beverage. In this type of dispensing the capsule is arranged in a position that is substantially reversed with respect to the position of capsules made according to steps (a) and (b1.1) to (b1.5); in this position the gas-impermeable film that closes the top opening interacts in known manner with a dispensing disc mounted in the infusion chamber of a dispensing machine. This type of capsule is shown in the exploded view of FIG. 4, wherein the flow of the infusion fluid is schematically indicated by way of arrows.

Figure 5:
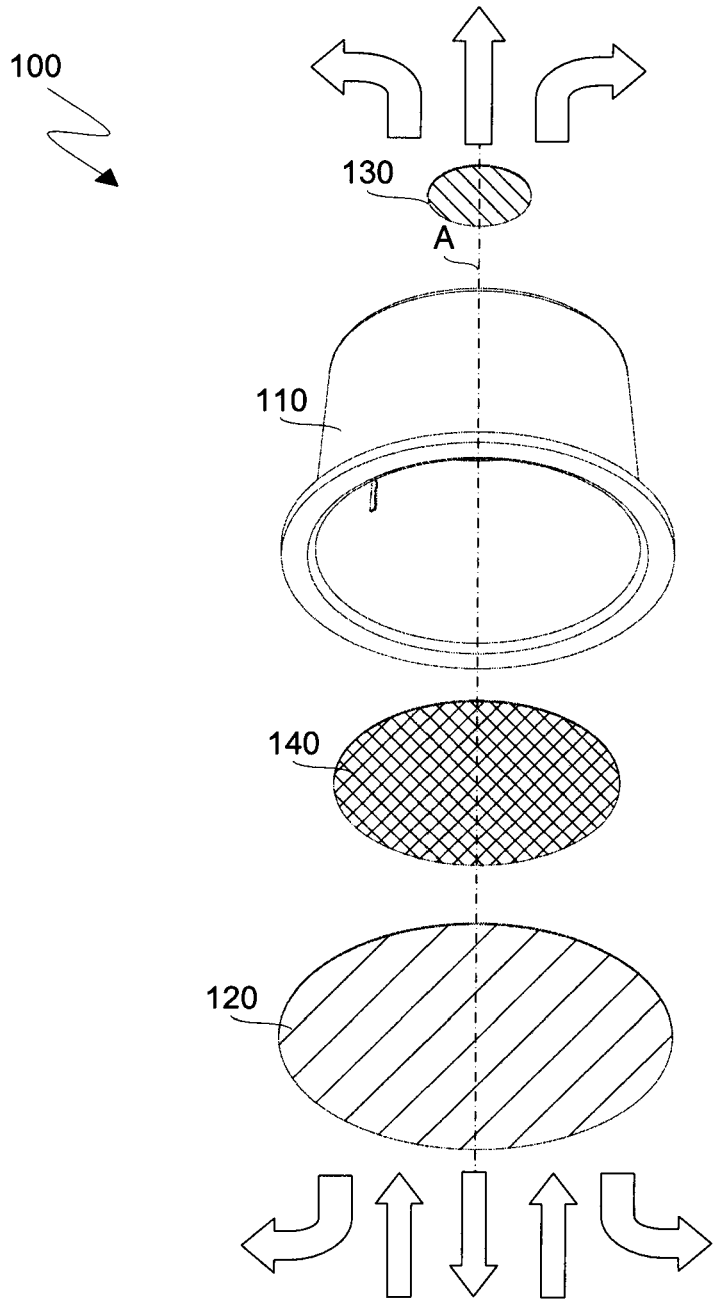

Single-dose capsule made according to steps (a) and (b3.1) to (b3.5) are configured in such a way that both the opening 114 formed on the bottom wall 111 and the top opening of the cup-shaped body 110 may either serve as inlet of the infusion liquid or as outlet of the infused beverage. This type of capsule is shown in the exploded view of FIG. 5, wherein the flow of the infusion fluid is schematically indicated by way of arrows.

The present invention has hereto been described with reference to preferred embodiments thereof. It is to be understood that there may be other embodiments relating to the same inventive idea, as defined by the scope of protection of the claims set out below.

The invention claimed is:

1. A method for the packaging of a dose of a product in granular or particulate form or in the form of a concentrated liquid in single-dose capsule for machines for dispensing beverages in the form of an infusion, said method comprising the steps of:

a) providing a one-piece, cup-shaped body having a circular bottom wall, a side wall extending radially away from the bottom wall, and an annular flange extending radially from the side wall at a position opposite from the bottom wall, the bottom wall, the side wall and the annular flange all being made of a same multilayer material and obtained by way of a co-injection molding process, said multilayer material comprising an inner layer and an outer layer both made of a structural material and an intermediate layer made of a barrier material adapted to prevent passage of oxygen, said body being common to each of said single-dose capsules; and b) configuring each capsule based on a specific machine for dispensing beverages in the form of an infusion by performing one of two following sets of operations on the cup-shaped body of step a):

b1-1) piercing the bottom wall of the cup-shaped body made from said multilayer material to form a bottom opening;

b1-2) sealing the bottom opening thus obtained by way of a gas-impermeable film made of a multilayer film optionally comprising a layer made of aluminum and a layer made of polypropylene;

b1-3) arranging a filter on the bottom wall;

b1-4) filling the cup-shaped body through a top opening with a measured dose of a product in granular or particulate form or in the form of a concentrated liquid; and b1-5) sealing the top opening of the cup-shaped body with a gas-impermeable film, said film being a polylaminate; or b3-1) piercing the bottom wall of the cup-shaped body made from said multilayer material to form a bottom opening;

b3-2) sealing the bottom opening thus obtained by means of a gas-impermeable film made of a multilayer comprising a layer made of aluminum and a layer made of polypropylene;

b3-3) arranging a filter on the bottom wall;

b3-4) filling the cup-shaped body through a top opening with a measured dose of a product in granular or particulate form or in the form of a concentrated liquid; and b3-5) sealing the top opening of the cup-shaped body with a gas-impermeable film, said film being a multilayer comprising a first layer made of aluminum and a second layer made of polypropylene.

2. The packaging method according to claim 1, wherein the polylaminate that seals the top opening of the cup-shaped body in step b1-5) comprises a first layer made of polyethylene terephthalate, a second layer made of aluminum and a third layer made of polypropylene.

3. The packaging method according to claim 2, wherein said first layer made of polyethylene terephthalate has a thickness of between 10 and 15 microns, said second layer made of aluminum has a thickness of between 35 and 40 microns and said third layer made of polypropylene has a thickness of about 20 microns.

4. The packaging method according to claim 1, wherein the polylaminate that seals the top opening of the cup-shaped body in step b1-5) comprises a first layer made of polyethylene terephthalate modified with EVOH, a second layer made of polyethylene terephthalate and a third layer made of polypropylene.

5. The packaging method according to claim 4, wherein said first layer of polyethylene terephthalate modified with EVOH has a thickness of between 10 and 15 microns, said second layer of polyethylene terephthalate has a thickness of between 10 and 15 microns and said third layer polypropylene has a thickness of about 30 microns.

6. The packaging method according to claim 1, wherein the multilayer used to seal the bottom opening formed in the bottom wall of the cup-shaped body in operations b1-2) and b3-2) comprises a first layer made of aluminum having a thickness of between 35 and 40 microns and a second layer made of polypropylene having a thickness of about 20 microns.

7. The packaging method according to claim 1, wherein the multilayer used to seal the top opening of the cup-shaped body in operation b3-5) comprises a first layer made of aluminum having a thickness of between 35 and 40 microns and a second layer of polypropylene having a thickness of about 20 microns.

8. The packaging method according to claim 1, wherein the filter used in operations b1-3) and b3-3) is made of paper.

9. The packaging method according to claim 1, wherein the structural material used for the manufacturing of the cup-shaped body is polypropylene and said barrier material is a copolymer of ethylene-polyvinyl alcohol.

10. The packaging method according to claim 1, wherein the inner layer, the outer layer, and the intermediate layer are each a continuous layer.

11. The packaging method according to claim 1, wherein the gas-impermeable film is applied to an exterior surface of the bottom wall.

12. The packaging method according to claim 11, wherein the filter is applied to an interior surface of the bottom wall.

* * * * *